US008074723B2

(12) United States Patent
Nutley et al.

(10) Patent No.: US 8,074,723 B2
(45) Date of Patent: Dec. 13, 2011

(54) RING MEMBER FOR A SWELLABLE DOWNHOLE PACKER

(75) Inventors: Kim Nutley, Inverurie (GB); Brian Nutley, Aberdeen (GB)

(73) Assignee: Swelltec Limited, Dyce, Aberdeen (GB)

( * ) Notice: Subject to any disclaimer, the term of this patent is extended or adjusted under 35 U.S.C. 154(b) by 0 days.

(21) Appl. No.: 12/427,026

(22) Filed: Apr. 21, 2009

(65) Prior Publication Data

US 2009/0260801 A1 Oct. 22, 2009

(30) Foreign Application Priority Data

Apr. 22, 2008 (GB) ..... 0807310.8

(51) Int. Cl.
*E21B 33/12* (2006.01)
*E21B 17/02* (2006.01)

(52) U.S. Cl. ..... 166/380; 166/196; 166/242.6; 166/387

(58) Field of Classification Search ..... 166/387, 166/380, 196, 179, 242.1, 242.6
See application file for complete search history.

(56) References Cited

U.S. PATENT DOCUMENTS

| | | | | |
|---|---|---|---|---|
| 2,144,026 | A * | 1/1939 | Park | 277/340 |
| 4,137,970 | A * | 2/1979 | Laflin et al. | 166/292 |
| 4,903,777 | A * | 2/1990 | Jordan et al. | 166/387 |
| 7,784,550 | B2 * | 8/2010 | Nutley et al. | 166/378 |
| 7,806,193 | B2 * | 10/2010 | Berzin et al. | 166/387 |
| 7,823,636 | B2 * | 11/2010 | Lucas | 166/119 |
| 2006/0124310 | A1 * | 6/2006 | Lopez de Cardenas et al. | 166/313 |
| 2008/0185158 | A1 * | 8/2008 | Chalker et al. | 166/387 |
| 2009/0139707 | A1 * | 6/2009 | Berzin et al. | 166/118 |
| 2009/0179383 | A1 * | 7/2009 | Koloy et al. | 277/338 |
| 2009/0229816 | A1 * | 9/2009 | Lemme et al. | 166/179 |
| 2009/0260801 | A1 * | 10/2009 | Nutley et al. | 166/118 |
| 2009/0272525 | A1 * | 11/2009 | Nutley et al. | 166/241.6 |
| 2009/0272541 | A1 * | 11/2009 | Nutley et al. | 166/378 |
| 2009/0277648 | A1 * | 11/2009 | Nutley et al. | 166/382 |
| 2010/0038074 | A1 * | 2/2010 | Patel | 166/187 |
| 2010/0051295 | A1 * | 3/2010 | Courville et al. | 166/387 |
| 2010/0243235 | A1 * | 9/2010 | Caldwell et al. | 166/118 |
| 2010/0263880 | A1 * | 10/2010 | Carter | 166/387 |
| 2010/0276137 | A1 * | 11/2010 | Nutley et al. | 166/185 |

FOREIGN PATENT DOCUMENTS

| | | | |
|---|---|---|---|
| EP | 2112324 | A1 * | 10/2009 |
| WO | WO 2008062178 | A1 * | 5/2008 |

* cited by examiner

*Primary Examiner* — Jennifer H Gay
(74) *Attorney, Agent, or Firm* — Wong, Cabello, Lutsch, Rutherford & Brucculeri, LLP

(57) ABSTRACT

A ring member for a downhole apparatus includes a swellable material selected to increase in volume on exposure to at least one triggering fluid. The ring member is configured to cooperate with a swellable member disposed on a body of the apparatus, and may function as a gauge ring or a retaining member. The ring member is secured to the apparatus via a coupling arrangement which couples the body to an adjacent well string section. The ring member may be threaded into the well string. Alternately, the ring member may be disposed over an upstanding formation such as a coupling sleeve by clamping.

34 Claims, 7 Drawing Sheets

RING MEMBER FOR A SWELLABLE DOWNHOLE PACKER

FIELD OF THE INVENTION

The present invention relates to a ring member for an apparatus for use downhole or in pipelines, in the particular field of oil and gas exploration and production. The invention also relates to an assembly incorporating a ring member and a method of forming such an assembly.

BACKGROUND

This application claims the benefit of United Kingdom Patent Application No. GB0807310.8, filed on Apr. 22, 2008, which hereby is incorporated by reference in its entirety.

In the field of oil and gas exploration and production, it is common to provide ring members on longitudinal tools, bodies, tubulars or mandrels. Typically, ring members are sized to be slipped on to the tubular or mandrel and moved longitudinally into the desired position where they are secured to the body. A typical function of a ring member is to prevent or restrict axial movement of an adjacent component on the body.

One particular application in which ring members are required is in the construction of swellable packers. A swellable packer includes a mantle of swellable elastomeric material formed around a tubular body. The swellable elastomer can be selected to expand by increasing in volume on exposure to at least one triggering fluid, which may be a hydrocarbon fluid or an aqueous fluid. The design dimensions and swelling characteristics are selected such that the swellable mantle expands to create a fluid seal in the annulus, thereby isolating one wellbore section from another. Swellable packers have several advantages over conventional packers, including passive actuation, simplicity of construction, and robustness in long term isolation applications. Examples of swellable packers are described in GB 2411918.

It will often be desirable to provide a ring member on either side of the swellable mantle. The ring member is secured to the main body of the tool, and is upstanding from the body. The ring member restricts or prevents axial movement of the swellable mantle on the body. It also provides stand-off protection for the swellable mantle and/or adjacent parts of the tool string during run-in. The ring member also provides an annular abutment surface for the swellable mantle which assists in reducing or preventing extrusion of the elastomer due to fluid pressure or pulling, i.e., downward, forces on the tubular. This improves the integrity of the seal provided by the packer.

Various methods have been used to secure retaining elements and gauge rings to the body. For example, a retaining element may be fixed by welding. In another technique, bolts are provided in threaded bores in the retaining element, and are screwed radially into the body, as described in co-pending International patent application number PCT/GB2007/004445 (published as WO2008/062178).

WO 2006/115417 discloses an alternative system which includes a ring fastener provided with protrusions on an inner surface which correspond to recesses in a body. The ring fastener is plastically deformed by radial shrinking of an outer sleeve so that the protrusions engage the recesses.

Although the system of WO 2006/115417 provides a convenient means for locating a cylinder on a base pipe, the assembly is limited in its resistance to axial forces. For example, during run-in, the outer sleeve may encounter an obstacle which imparts an impulse or tensile force that is large enough to overcome the frictional contact between the base pipe and the fastener. This can result in axial displacement of the sleeve on the body. If the outer sleeve is also required to function as a gauge ring and/or is required to provide stand-off to the base pipe during run-in, the problem is exacerbated. Similar difficulties may apply during use of the apparatus. For example, if the outer sleeve is part of a packer assembly or anchor which couples a tubular to the inner surface of an outer casing or an openhole, a downward weight or pulling force on the tubular is opposed by the outer sleeve, which may be sufficient to overcome the frictional force between the base pipe and the fastener. In addition, the ring fastener of WO 2006/115417 is only suitable for coupling to a body that is provided with recesses in its outer surface.

It is one object of an aspect of the invention to provide a ring member—which may be a gauge ring or a retaining member—for a downhole apparatus which overcomes the deficiencies of the prior art ring members. It is a further aim of the invention to provide an alternative ring member to those proposed in the prior art.

It is another object of an aspect of the invention to provide an assembly of a body and a ring member which has a greater resistance to axial forces and greater structural integrity when compared with prior art assemblies.

It is a further aim of the invention to provide a retaining element which may be used with standard equipment, such as American Petroleum Institute (API) tubular sections and couplings.

Additional aims and objects of the invention will become apparent from the following description.

SUMMARY OF THE INVENTION

According to a first aspect of the invention, there is provided a well string assembly comprising a well string section; a body; a swellable member disposed on the body, the swellable member comprising a material selected to expand on exposure to at least one triggering fluid; a coupling arrangement which couples the body and the well string section; and a ring member in cooperation with the swellable member and secured to the assembly via the coupling arrangement.

According to a second aspect of the invention, there is provided a ring member for a downhole assembly, the ring member configured to cooperate with a swellable member disposed on a body of an apparatus, the swellable member comprising a material selected to expand on exposure to at least one triggering fluid; wherein the ring member is further configured to be secured to the apparatus via a coupling arrangement which couples the body and a well string section in use.

According to a third aspect of the invention, there is provided an apparatus configured to form part of a well string, the apparatus comprising: a body having a swellable member disposed thereon, the swellable member comprising a material selected to expand on exposure to at least one triggering fluid, the body being configured to be coupled to a well string section by a coupling arrangement; and a ring member configured to cooperate with the swellable member in use, and further configured to be secured to the well string via the coupling arrangement.

According to a fourth aspect of the invention, a body and ring member are provided as a kit of parts, the kit of parts being configured to be assembled to form the apparatus of the third aspect of the invention. The kit of parts may further comprise the swellable member, which is configured to be disposed on the body.

The first through fourth aspects of the invention have various common preferred and optional features as follows.

The ring member may cooperate with the swellable member to perform one or more of: inhibiting axial movement of the swellable member on the body; inhibiting extrusion of the swellable member or a part of the swellable member on the body; providing stand-off protection to the swellable member and/or the well string; or providing centralization of the body and/or swellable member in the wellbore. The ring member may comprise an annular abutment surface for the swellable member, which may be located at a first end of the ring member.

By providing a ring member which cooperates with the swellable member and is secured by a coupling arrangement, the present invention provides greater resistance to axial forces and/or greater structural integrity when compared with assemblies of the prior art.

In one embodiment, the coupling arrangement comprises a threaded connection, which may be configured to couple the body to a corresponding threaded connection on a well string section. The threaded connection may comprise a first threaded section on the body and a second threaded section on a well string section. The first threaded section may be configured to be threaded with the second threaded section. The ring member may therefore form a part of the coupling arrangement, and may function to couple the body with an adjacent well string section. In this configuration the ring member is threaded into the well string assembly in use, and forms an integral part of the well string assembly.

Alternatively, or in addition, the threaded connection may further comprise a coupling member having first and second ends which thread with the first and second threaded sections. The coupling member may, for example, be a coupling sleeve. The coupling member may comprise a first box thread section for receiving a pin thread section of the body, and may comprise a second box thread section for receiving a pin thread section of a well string section. The coupling member may alternatively comprise at least one pin thread section. The coupling member may be a cross-over coupling.

The coupling arrangement may comprise a formation upstanding from the assembly. For example, the coupling arrangement may comprise a coupling member having a threaded section which is configured to be threaded to a well string, wherein the coupling member has an outer diameter greater than that of the well string.

The ring member may comprise one or more part-cylindrical elements, and may comprise an open configuration and a closed configuration. In its closed configuration, the ring member may be arranged to be secured on the coupling arrangement. The ring member may be configured to be clamped onto or over a coupling arrangement.

According to an embodiment of the invention, the ring member comprises an internal profile, shaped to accommodate a formation upstanding from the assembly. The formation may be a tool joint or a part thereof.

The ring member may be configured for threaded connection to the body and/or well string. The body and ring member may comprise corresponding threaded profiles, which may be wedge thread sections. The threaded profiles may be square threads or buttress threads. Preferably, the threaded profiles are buttress threads.

The threaded profile may be provided with a shoulder which abuts an end of a pin threaded section on coupling. The threaded profile may also be provided with a relief section, which may be an annular recess, disposed between the thread and the shoulder. The shoulder may be arranged such that, when the end of a pin threaded section abuts the shoulder, the coupling between the threaded profiles is over-torqued. In this context, over-torqued means having a torque rating in excess of the typical torque rating used for a similar threaded profile in a pipe coupling application.

Preferably, the threaded profile is connected with a torque rating in excess of a torque rating of a coupling between the ring member and well string section. More preferably, the threaded profile is connected with a torque rating in excess of a torque rating of a coupling between a first well string section and a second well string section.

The threaded profile may be arranged to provide a seal between respective threaded sections. In one embodiment, a seal may be provided between the shoulder and an end of a pin threaded section. The seal may be provided by a metal-to-metal seal between the shoulder and an end of a pin threaded section. Alternatively, or in addition, a seal ring may be disposed between the respective threaded sections. The seal ring may, for example, be a metal seal ring or may be a ring comprising TEFLON® fluoropolymer. (TEFLON is a registered trademark of E. I. du Pont de Nemours and Company.)

According to a fifth aspect of the invention, there is provided a method of forming a swellable packer on a well string, the method comprising the steps of: (a) providing a swellable member on a body, the swellable member comprising a material selected to expand on exposure to at least one triggering fluid; (b) providing a coupling arrangement for coupling the body to a well string section; and (c) securing a ring member to the well string via the coupling arrangement such that the ring member cooperates with the swellable member.

The method may further include the step of securing the ring member to the body by a first threaded connection in the ring member. The method may also include the additional step of coupling the ring member to a well string using a second threaded connection.

Alternatively, the method may include the step of securing the ring member to the body by disposing the ring member over a formation upstanding from the body.

According to a sixth aspect of the invention, there is provided a method of forming a well string, the method comprising the steps of: (a) providing a swellable member on a body, the swellable member comprising a material selected to expand on exposure to at least one triggering fluid; (b) coupling the body to a well string section with a coupling arrangement; and (c) securing a ring member to the body by a first threaded connection in the ring member; and (d) coupling the ring member to a well string using a second threaded connection.

Embodiments of the fifth and sixth aspects of the invention may comprise optional and preferred features of the first to fourth aspects of the invention. In particular, the ring member may cooperate with the swellable member, performing one or more of the following: inhibiting axial movement of the swellable member on the body; inhibiting extrusion of the swellable member or a part of the swellable member on the body; providing stand-off protection to the swellable member and/or the well string; or providing centralization of the body and/or swellable member in the wellbore.

According to a seventh aspect of the invention, there is provided an apparatus configured to form part of a well string, the apparatus comprising: a body comprising a threaded section; a swellable member disposed on the body and comprising a material selected to expand on exposure to at least when triggering fluid; and a ring member comprising a first threaded coupling configured to be coupled to the threaded section of the body, and a second threaded coupling configured to be coupled to a well string section.

According to an eighth aspect of the invention, there is provided a well string assembly comprising a well string section; a body comprising a threaded section; a swellable member disposed on the body, the swellable member comprising a material selected to expand on exposure to at least when triggering fluid; and a ring member in co-operation with the swellable member and having a first end and an opposing second end, wherein the ring member is coupled to the threaded section of the body at its first end, and is coupled to the well string section at its second end.

The well string section may be a second body with a second swellable member disposed thereon. The ring member may therefore be coupled into, and form a part of, the assembled well string.

According to a ninth aspect of the invention, there is provided a ring member configured to cooperate with a swellable member on a body of an apparatus, the swellable member comprising a material selected to expand on exposure to a triggering fluid; wherein the ring member comprises a first coupling configured to be coupled to a threaded section on the body of the apparatus, and a second coupling configured to be coupled to a well string section in use.

According to a tenth aspect of the invention, there is provided a well string sub assembly configured to form part of a well string, the sub assembly comprising a first end and an opposing second end, the first end comprising a coupling configured to be connected to the body of a swellable apparatus, and a second end comprising a second coupling configured to be connected to a well string section, wherein the sub assembly is configured to cooperate with a swellable member of the swellable apparatus in use.

According to an eleventh aspect of the invention, there is provided a ring member for a well string, the ring member comprising a body configured to be secured to an upstanding formation on a well string, wherein the ring member is configured to cooperate with a swellable member of the swellable apparatus in use.

The upstanding formation on the wellbore may be a part of a tool joint or coupling arrangement between a body and a well string section. The body may be configured to support a swellable member in use. The ring member may comprise a mating profile, and may comprise a reduced bore section for coupling with the upset profile of a tool joint.

Embodiments of the seventh through eleventh aspects of the invention may comprise optional and preferred features of the first through fourth aspects of the invention. In particular, the ring member may cooperate with the swellable member, and may perform one or more of: inhibiting axial movement of the swellable member on the body; inhibiting extrusion of the swellable member or a part of the swellable member on the body; providing stand-off protection to the swellable member and/or the well string; or providing centralisation of the body and/or swellable member in the wellbore.

The terms upper, lower, above, below, up, and down are used herein to indicate relative positions in the wellbore. The invention also has applications in wells that are deviated or horizontal, and when these terms are applied to such wells, they may indicate left, right, or other positions in the context of the orientation of the well.

DETAILED DESCRIPTION

Figure 1:
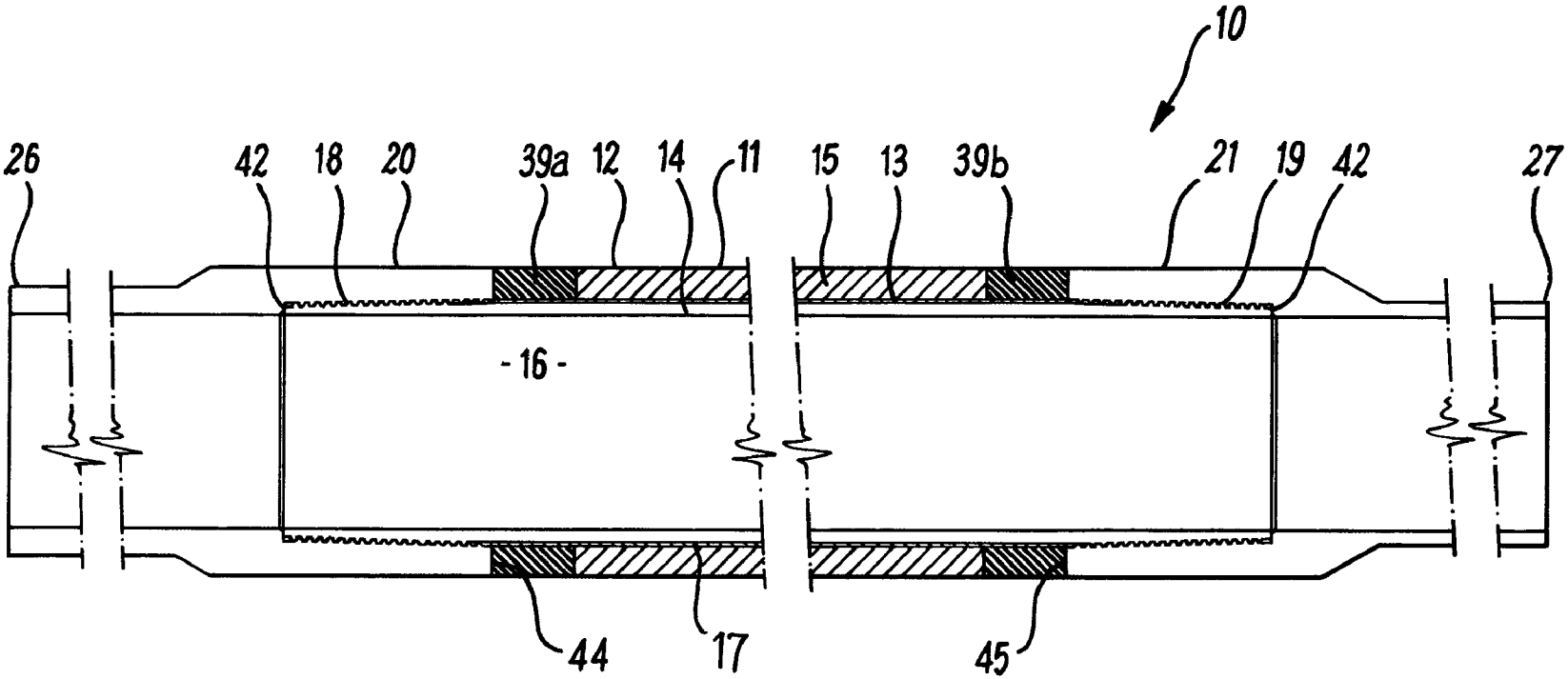
FIG. 1 is a longitudinal section through an assembly comprising ring members in accordance with an embodiment of the invention.

Referring firstly to FIG. 1, there is shown an assembly, generally depicted at 10, which forms a wellbore packer. The assembly 10 comprises a packer arrangement 11 formed on a body 14 and a pair of ring members 20 and 21. The body 14 is substantially cylindrical, and defines an internal throughbore 16. In this embodiment, the body 14 is a casing section having connectors 18 and 19 at opposing ends. The connectors are standard API buttress casing pin threads, which are preferred due to their high tensile strength and the large range of torque that can be applied to the coupling. They also provide a fluid seal between the outer diameter (OD) surface of the pin thread and the inner diameter (ID) surface of the box thread. In some applications, it is not necessary to effect a seal in the thread form of the mated connectors 32 and 33, and other thread types may be used.

The wellbore packer assembly 10 includes a swellable member 12 disposed on the body 14, which consists of an inner mantle 13 and an outer mantle 15. The inner mantle 13 comprises a layer 17 which is relatively thin and has a small OD compared to the thickness (and OD) of the swellable member 12. The inner mantle comprises annular end portions 39*a*, 39*b* which are formed to the full thickness (and OD) of the swellable member 12. The outer mantle 15 surrounds the layer 17 of the inner mantle and has an OD corresponding to that of the annular end portions 39*a*, 39*b*. The inner mantle 13 is bonded to the body 14 by a suitable bonding agent.

The design, dimensions and swelling characteristics of the packer are selected such that the swellable mantle expands to create a fluid seal in an annulus defined by the assembly and an outer casing or uncased hole. The inner and outer mantles are in this example formed from ethylene propylene diene monomer (EPDM) elastomers which swell on exposure to hydrocarbon fluids. The elastomer of the inner mantle is selected to be relatively hard and relatively highly crosslinked, compared to the elastomer of the outer mantle. This facilitates bonding of the swellable member to the metal body 14. In addition, the inner mantle has a low swell rate compared to the outer mantle, which also reduces the tendency of the annular rings 39*a*, 39*b* to extrude over the ring members 20, 21 in use.

Figure 2:
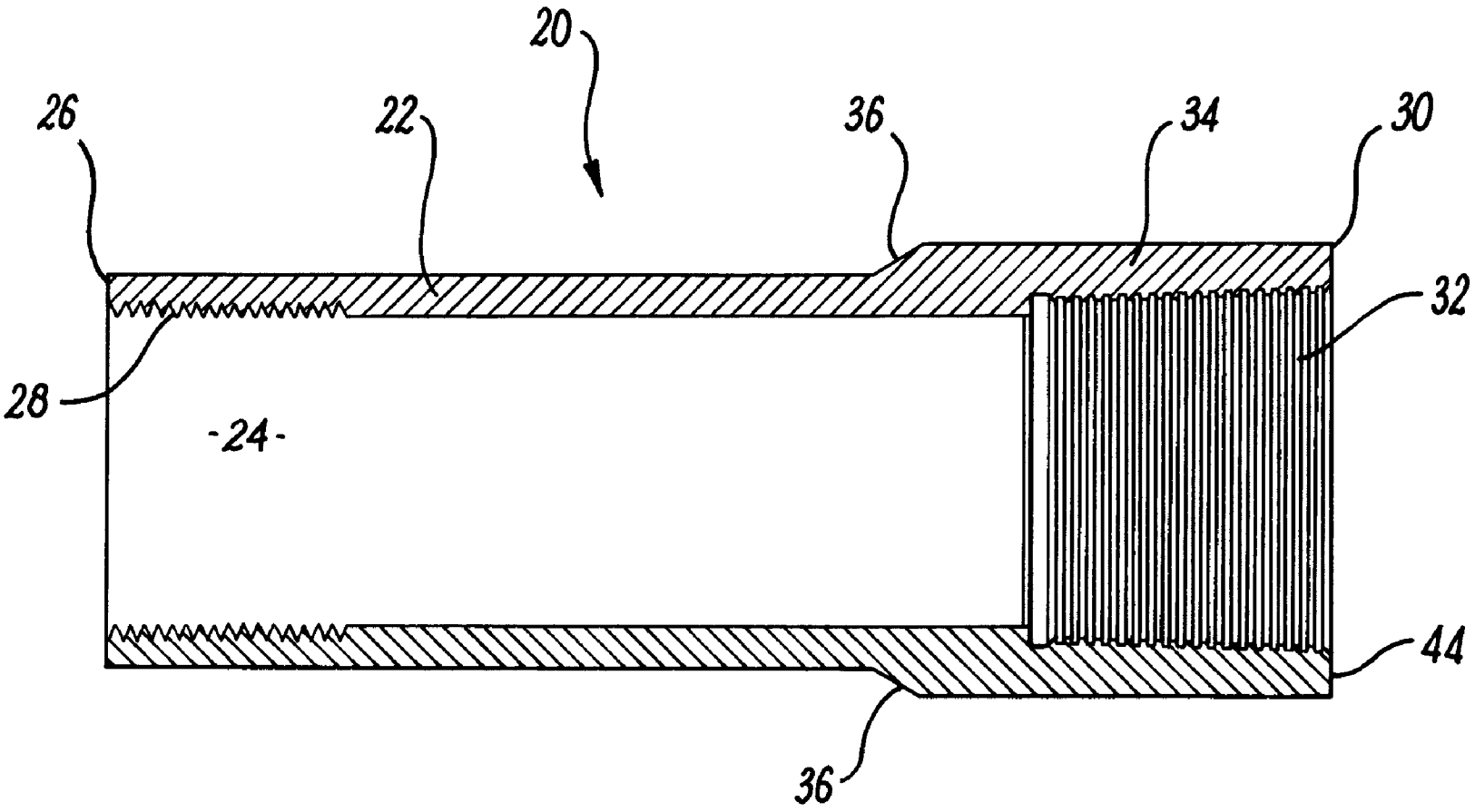
FIG. 2 is a longitudinal section through a ring member of the embodiment of FIG. 1.

Referring now to FIG. 2, there is shown in longitudinal section a ring member, generally shown at 20. The ring member 20 comprises a substantially cylindrical body 22 defining a throughbore 24. A first end 26 of the body 22 is provided with a connector in the form of an API threaded box section 28. A second, opposing end 30 is provided with a second connector 32, described in more detail below. Located towards the second end 30, and extending beyond the longitudinal extent of the connector 32, is a section 34 of enlarged OD, which is upset from the main body 22. A chamfered (or frusto-conical) portion 36 is located between the main body 22 and the upset section 34.

Figure 3:
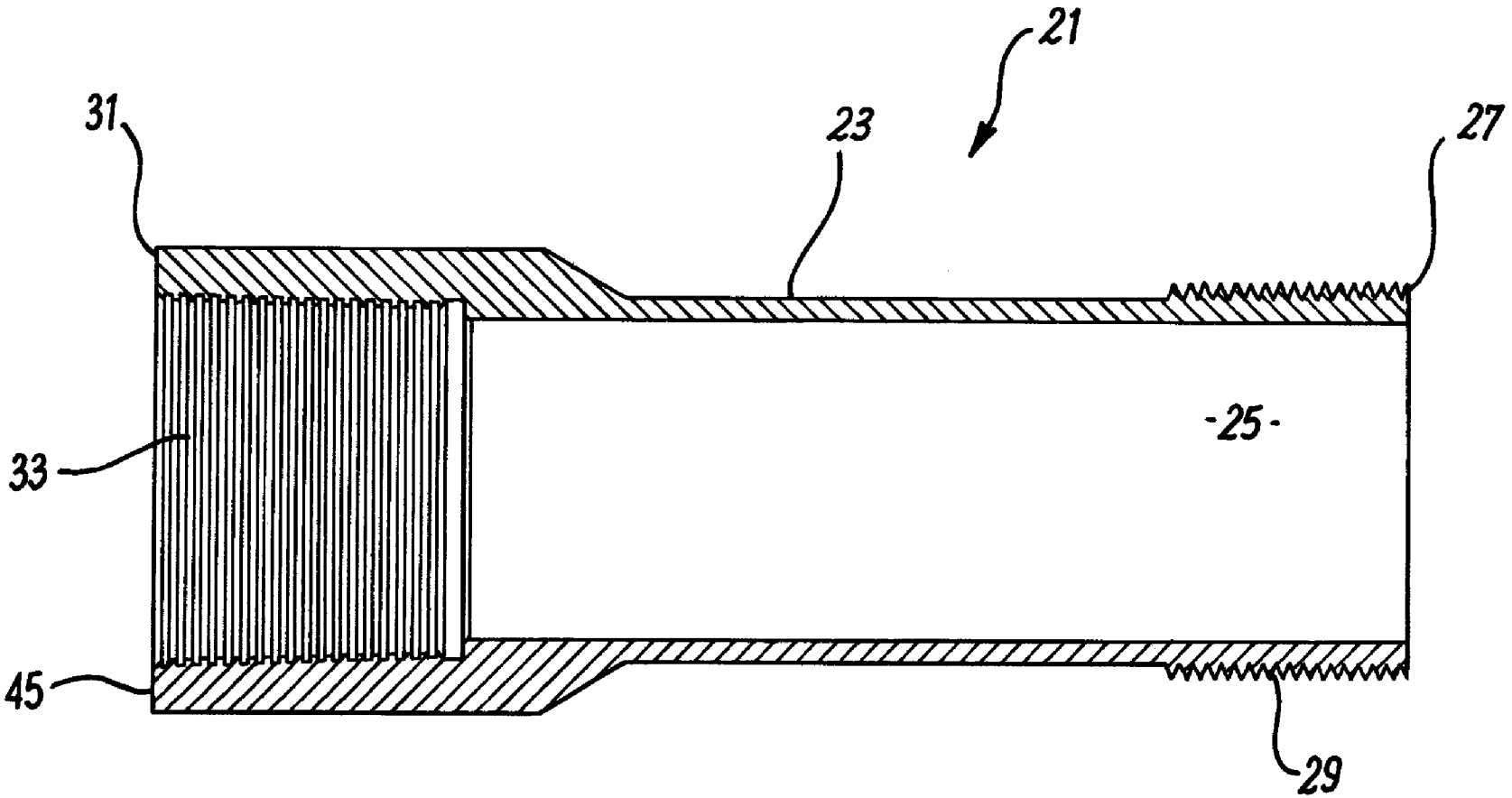
FIG. 3 is a longitudinal section through another ring member of the embodiment of FIG. 1.

Referring now to FIG. 3, there is shown a ring member in accordance with an alternative embodiment of the invention, generally depicted at 21. The ring member 21 is similar to the ring member 20 of FIG. 2. The ring member 31 comprises a main body 23, and defines a bore 25. A first end 31 of the ring member 21 is provided with connector 33. A second, opposing end 27 of the ring member 21 comprises a connector 29 in the form of an API pin threaded section.

The connectors 32, 33 comprise threaded recesses which correspond to the connectors 18, 19 on the body 14. In this case, the connectors 32, 33 are modified buttress casing box thread sections configured to receive the pin thread of connector 18.

Figure 4:
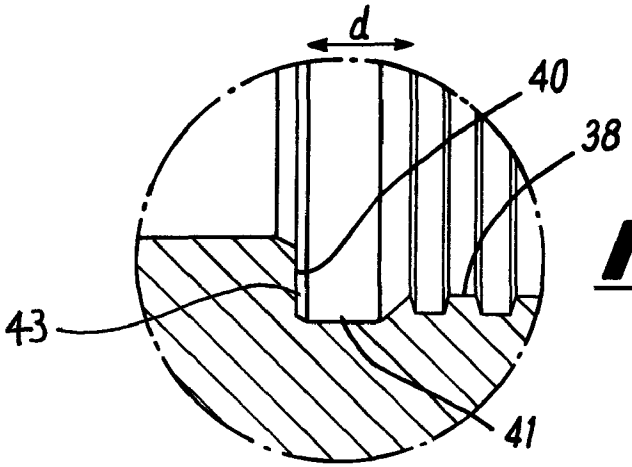
FIG. 4 is an enlarged view of a detail of the thread used in embodiments of FIGS. 1 and 2.

FIG. 4 shows detail of the termination of the connectors 32 and 33. An annular relief section 41 is provided adjacent the end of the box thread. An internal shoulder 40 bounds the relief section 41, and is longitudinally separated from the thread 38 by a distance d. The shoulder defines an abutment surface for the ends 42 of the body 14. When the body 14 and the members 20, 21 are threaded together, the shoulder 40 comes into abutment with the end 42 of the body, inhibiting further longitudinal threading of the ring members 20, 21 into their corresponding thread forms.

The distance d is selected according to the standard depths to which the threads are typically made up in general pipe coupling applications. A pipe coupling will have a torque range depending on the type of thread connection used, the pipe characteristics, and the application. In the case of an API buttress thread, a preferred torque range corresponds to a coupling depth to which the pin is threaded into the box section. The coupling depth is typically visibly marked on the pin section, so that the coupling can be made up without measuring the applied torque. In the present embodiment, the distance d is selected to match or slightly exceed this coupling depth, so that the pin section penetrates to at least its usual depth (and usual torque) until the end 42 abuts the shoulder 40. Further torque may be applied to the corresponding components, to effect a metal-to-metal seal 43 between the shoulder 40 and the end 42. In addition, the excess torque applied to the coupling (which still falls within the large guaranteed torque range of the chosen thread) ensures that the torque value at the coupling is higher than the torque value for the coupling between adjacent pipe sections. This means that the assembly will not come unthreaded at the packer arrangement, providing additional assurance for the integrity of the seal created by the packer in its swollen condition.

This arrangement also provides a fixed distance between the respective ends 30, 31 of the ring members 20, 21 in the assembly 10. This provides the advantage that, when assembling a swellable packer, the ring members may be prevented from compressing or otherwise deforming the swellable mantle. Such compression may increase the OD of the swellable mantle before run-in of the apparatus and increase the risk of snagging during run-in and/or extrusion during use downhole.

The assembly 10 comprises a continuous bore defined by the throughbores 16, 24, 25 of the respective components. End 26 of the assembly 10 comprises an API box thread for connection to a corresponding pin thread of an adjacent section in a well string. End 27 comprises an API pin thread connector 29 for connection to a corresponding box thread section in an adjacent section in the well string. The resulting well string is therefore provided with an integrally formed wellbore packer for creating a seal in the wellbore. The ring members 20 and 21 function as gauge rings and retaining elements for the packer during run-in. Stand-off protection is provided to the swellable member and adjacent parts of the well string. In addition, the upset OD profile of the ring members 20, 21 defines abutment surfaces 44, 45 at ends 30, 31 of the respective ring members. These surfaces 44 and 45 provide annular extrusion barriers for the swellable member in use.

The ring members also resist axial movement of the swellable mantle on the body. The resistance to axial forces is improved with respect to the prior art by virtue of being secured via the coupling members of the apparatus.

In addition, by providing a ring member in the form of sub assembly which forms part of the well string, the ring member is integral with the well string and is formed to the same tensile and compressive strength as the pipe string itself. Thus, the assembly is able to withstand loads experienced during wellbore completion operations. Axial loads are directed through the pipe body rather than through the swellable packer element. The arrangement has a small number of machined parts, reducing tendency for parts to come loose from the apparatus, such as might be the case with screws threaded into an end ring.

The ring members can be formed as crossover subs with a variety of thread arrangements which are suited to a specific installation or well string. This allows the body 14 and swellable member to be standardized, with corresponding standardized couplings provided at one end of the ring member. This offers flexible construction options and promotes inventory stocking of the swellable packer equipment. In addition, no assembly of the final packer arrangement 12 is required. The packer arrangement is simply assembled into any well string by selecting crossover ring members 20, 21 suitable for connection with the well string sections. The body is threaded onto the ring members and adjacent pipe bodies in the well string.

Having fewer component parts enables more effective quality assurance control, reduces the cost of manufacture. The arrangement is also easier to ship, with reduced component weight and compact storage.

Figure 5:
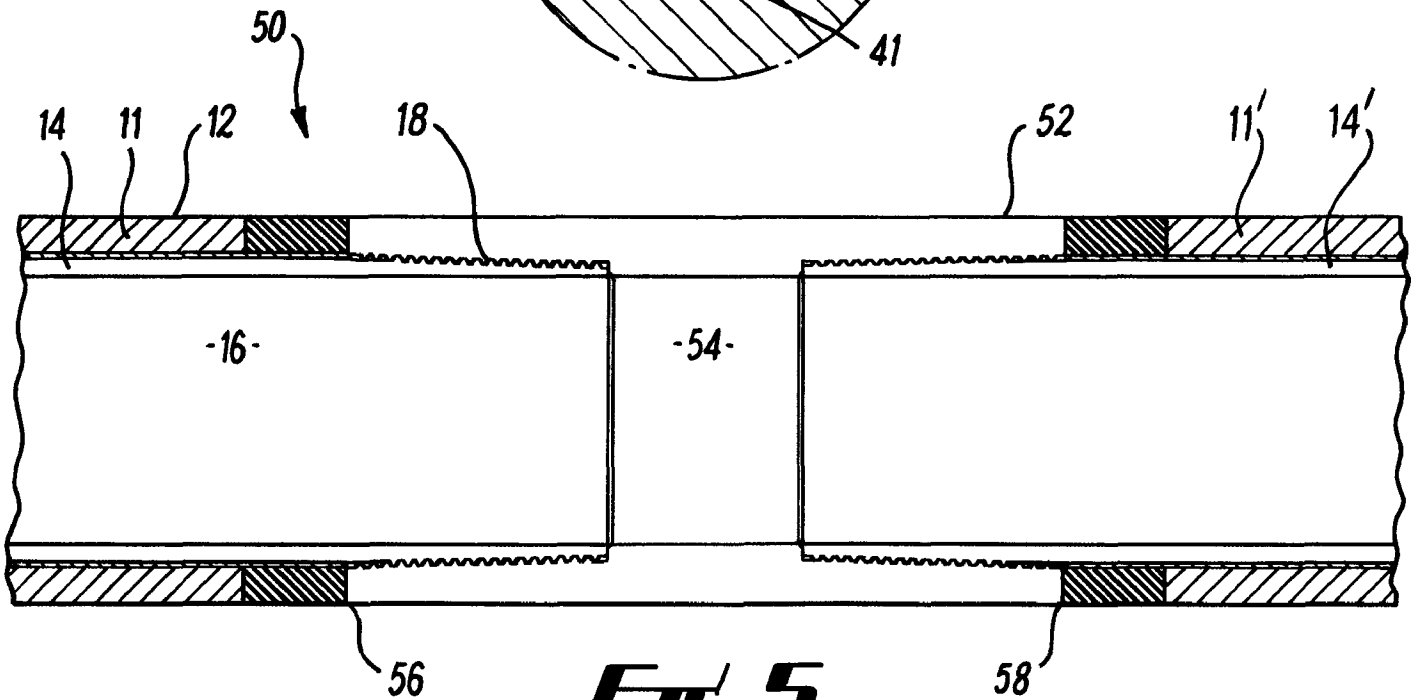
FIG. 5 is a longitudinal section through an assembly comprising ring members in accordance with an alternative embodiment of the invention.

It will be appreciated that the ring members could take a different form. FIG. 5 is a longitudinal section view of an assembly 50 in accordance with an alternative embodiment of the invention. The assembly 50 comprises a packer arrangement 11 comprising a swellable mantle 12 on a body 14, and a ring member 52. The packer arrangement 11 is similar to the packer arrangement of FIG. 1, with like parts designated by like reference numerals. The ring member 52 comprises a cylindrical body defining a throughbore 54, which is a continuation of the bore defined by the body 14.

The OD of the ring member 52 is sized to correspond to the outer diameter of the swellable member 12. End 56 of the ring member 52 comprises a modified buttress threaded box section which corresponds to the pin threaded section 18 on body 14. The ring member 52 differs from the ring members 20, 21 in that the opposing end 58 is also provided with a modified buttress threaded box section. Thus, the ring member 52 provides the coupling arrangement for the body 14 to an adjacent pipe section, which in this case is a packer arrangement 11', formed on body 14'.

As with the embodiment of FIG. 1, the ends of the ring member 52 define abutment surfaces which provide annular extrusion barriers for the swellable member in use. The ring member 52 also provides standoff protection and axial retention of the swellable member on the body 14.

The embodiment of FIG. 5 demonstrates a way in which the invention can provide a modular system of components or a kit of parts, which can be used to create well strings with multiple packer sections longitudinally displaced along the string. The invention lends itself well to modular systems, and in particular is compatible with the modular system—including the centralizing and anti-extrusion components—described in co-pending International application numbers PCT/GB2007/004445 (published as WO2008/062178) and PCT/GB2007/004453 (published as WO2008/062186).

The above-described embodiments include ring members which are formed to the same outer diameter as the swellable mantle. In an alternative embodiment (not illustrated), the ring members have a larger OD than the swellable member in its unswelled condition. This provides increased stand-off protection for the swellable member and adjacent parts of the tool string and also offers better anti-extrusion resistance for the swellable mantle when in its expanded condition.

In a further embodiment (not illustrated), the ring members 20 and/or 21 have features typically associated with centralizing apparatuses and perform a centralizing function in use. In one example, the ring members 20 and/or 21 are provided with upstanding formations, such as longitudinal or helical blades, which provide increased stand-off protection and allow fluid to bypass the ring members. In a further example (not illustrated), the ring member has resilient bow spring structures to provide centralization and stand-off while allowing negotiation of obstacles in the wellbore and fluid bypass. The upstanding formations and/or bow spring structures may be integrally formed or of unitary construction with the ring member. In a further alternative embodiment of the invention (not illustrated), the ring member is provided with inserts on its outer surface, which may be ceramic inserts bonded onto the ring member. In another embodiment of the invention (not illustrated), the ring member comprises an axially extended body portion which provides a supporting surface for a tool element to be located on the ring member. For example, centralizers, clamps, or friction-reducing tools could be disposed on the outer surface of the ring member and may be configured to rotate on the ring member.

In the above-described embodiment, the thread connectors in the ring members 20 and 21 are buttress threads, although it will be appreciated that, in alternative embodiments, the threads could be other standard API threads, or premium threads produced by different thread manufacturers. For example, the VAM® series threads produced by Vallourec & Mannesmann Oil & Gas may be used. (VAM is a registered trademark of Vallourec & Mannesman Oil & Gas.) In a variation to the thread arrangement, a relief section provided in the ring member accommodates a sealing member, which may, for example, be a metal or TEFLON® fluoropolymer ring that is compressed between the elements of the coupling arrangement to provide a fluid seal. (TEFLON is a registered trademark of E. I. du Pont de Nemours and Company.)

Figure 6A:
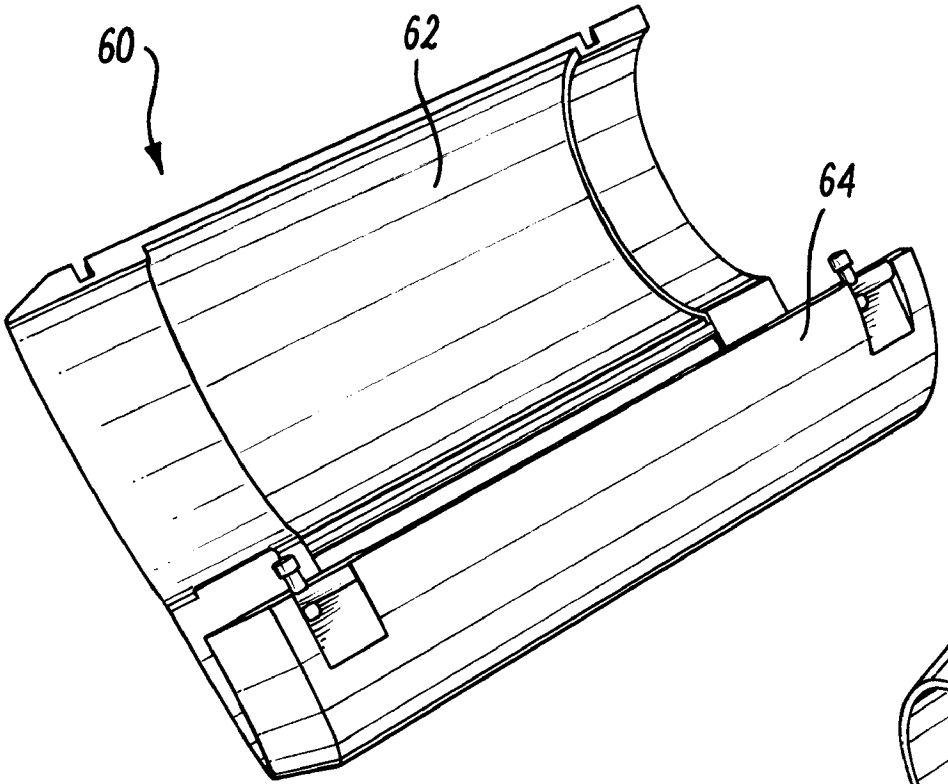
FIGS. 6A and 6B are perspective views of a retaining element in accordance with an alternative embodiment of the invention, shown in open and closed configurations respectively.
Figure 6B:
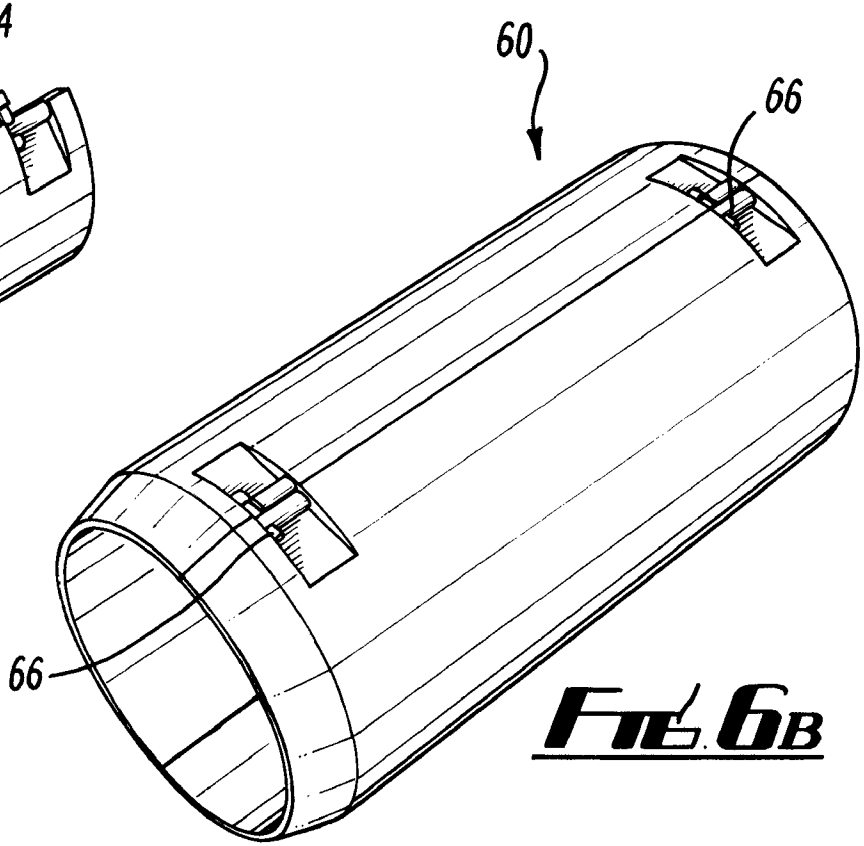

FIGS. 6A and 6B illustrate an alternative embodiment of the invention, in which a ring member, generally shown at 60, is a clamp-type arrangement formed from two semi-cylindrical components 62, 64. The two components 62, 64 are longitudinally hinged and are shown in FIG. 6A in an open configuration. FIG. 6B shows a closed configuration, in which the semi-cylindrical components 62, 64 are closed and secured together using locking bolts 66.

Figure 7:
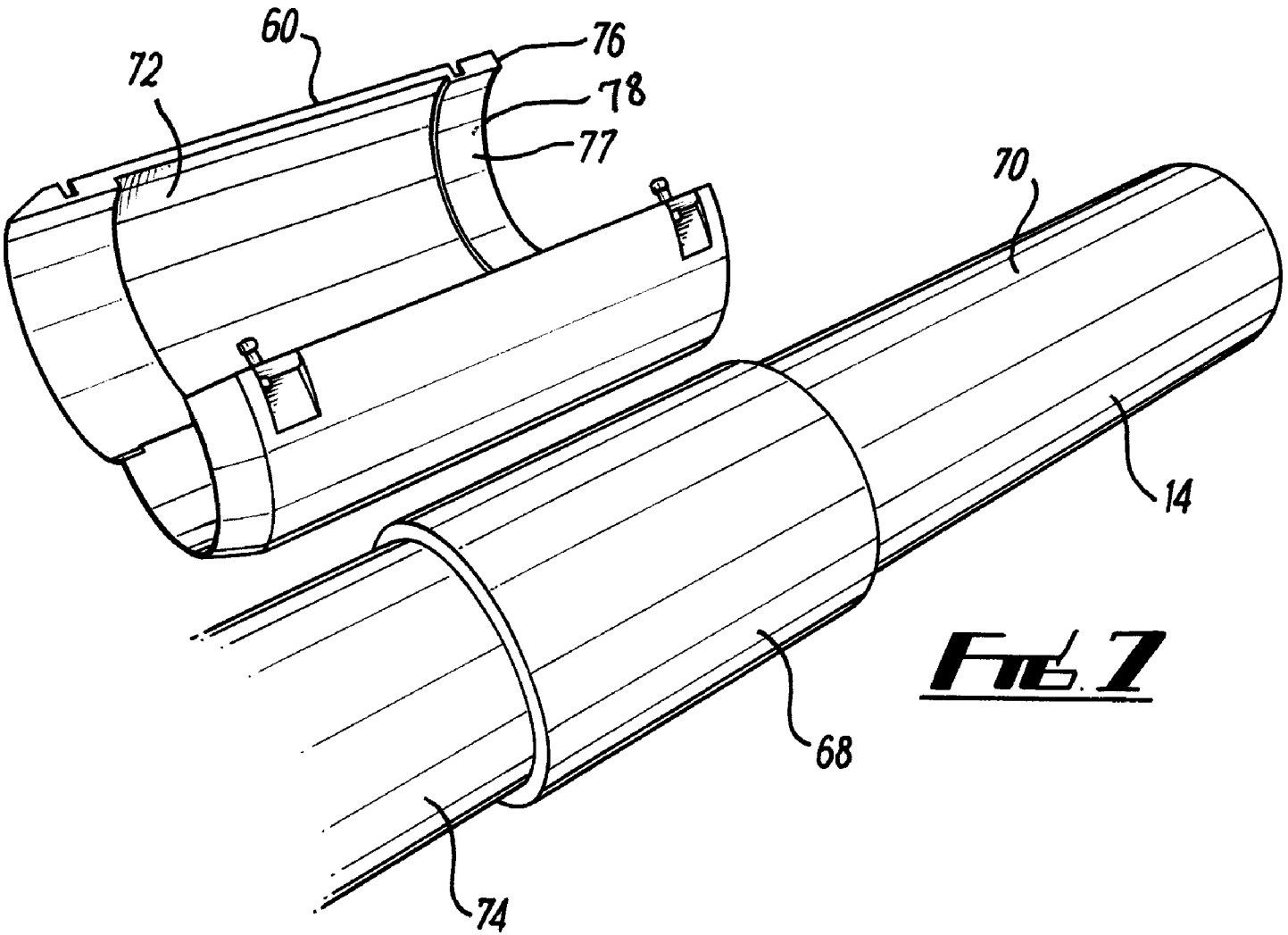
FIG. 7 is a perspective view of the ring member of FIGS. 6A and 6B prior to attachment to a coupling arrangement.

As illustrated in FIG. 7, the embodiment of FIGS. 6A and 6B is configured for attachment to a coupling arrangement 68 which upstands from a well string 70. The ring member 60 comprises an internal profile which provides an enlarged bore portion 72 corresponding to an upstanding coupling arrangement 68 on a pipe. The upstanding formation 68 in this case is a coupling member which is provided with threaded box sections at opposing ends for receiving corresponding pin sections of casing section 74 and packer body 14. It will be appreciated that in alternative embodiments, ring members may be configured for placement over other types of coupling arrangement or tool joint which upstand from the body.

The ring member 60 is placed over the joint 68, and at its end 76 provides an abutment surface 78 for a swellable packer element (not shown) disposed on the body 14. The abutment surface 78 is placed against an end of the swellable packer element and prevents or restricts axial movement on the body and reduces extrusion of the swellable member in use. The ring member also functions as a gauge ring and provides stand-off protection.

In alternative embodiments of the invention, the ring member may be configured to accommodate and/or clamp a cable or line extending through the ring member along the outside of the well string.

Figure 8:
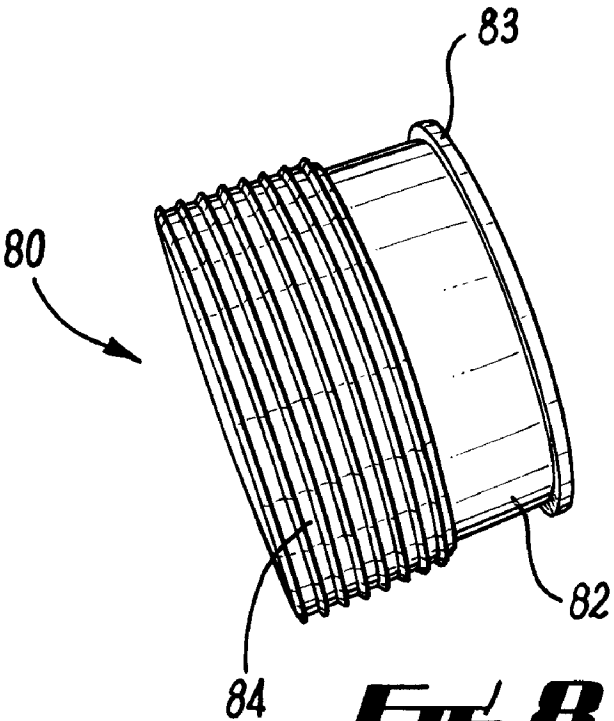
FIG. 8 is a perspective view of a mating ring used with the retaining element of FIGS. 6A and 6B.

FIG. 8 shows an additional mating component 80 which may be accommodated by the ring member 60. The mating component 80 comprises an annular recess 82 which receives the reduced annular inner diameter portion 77 of the ring member 60 and a lip 83, such that the two components may be longitudinally keyed. The mating component 80 comprises a mating profile 84, which is selected to correspond to a mating profile provided in a swellable member, such as is described in co-pending International patent application number PCT/GB2007/004445. A further alternative embodiment (not illustrated) provides a shim member, with a formation (similar to the recess 82 and lip 83) that permits it to be longitudinally keyed with the ring member. The shim member provides an extension of the ring member 60, such that it abuts the swellable member and provides the same functions of the abutment surface 78.

Figure 9:
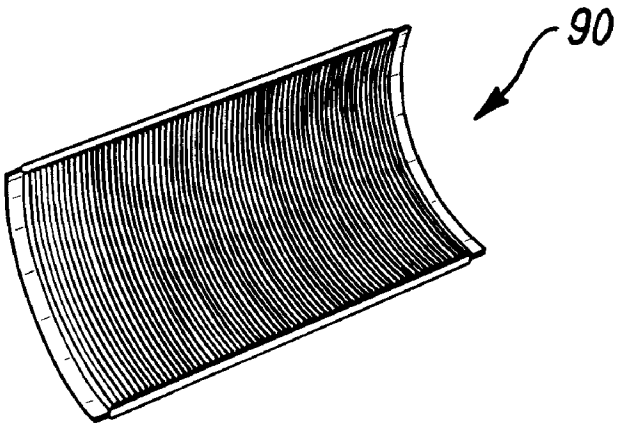
FIG. 9 is a perspective view of an anti-slip member used in accordance with the embodiment of FIGS. 6A and 6B.

FIG. 9 shows an anti-slip component 90 which may be accommodated in the ring member 60 between the upstanding surface of the coupling arrangement 68 and the enlarged bore section 72 of the ring member to increase frictional contact and provide for increased axial strength of the assembled apparatus.

Although in the above-described embodiments, the swellable member of the packer is described as being bonded to the body, it is within the scope of the invention to provide packer elements which are slipped on to the body to the desired location and axially retained by the ring members of the invention. In one arrangement, a string of multiple swellable members are located on a body adjacent to one another with ring members of the invention cooperating with the swellable members at either end of the string. In this arrangement, multiple swellable members are used to construct a packer with a sealing length equal to several lengths of the swellable members used. Thus, the invention provides a convenient way of configuring a packer from a modular system of components. It may be desirable in some applications to bond the swellable member onto a body after sliding it on to the desired location.

The invention is described in the context of swellable members which expand on exposure to triggering fluids, but it also has application to swellable members which increase in volume in response to other triggering mechanisms, as well as other combinations with features other than those expressly claimed herein.

What is claimed is:

1. A well string assembly comprising:

a well string section;

a swellable wellbore packer section, comprising:

a substantially cylindrical body; and a swellable member disposed on the body, the swellable member comprising a material selected to expand on exposure to at least one triggering fluid to create a fluid seal in a wellbore annulus; and a coupling arrangement which couples the body and the well string section comprising:

a ring member secured in the assembly that forms an annular abutment surface that cooperates with the swellable member to inhibit axial movement of the swellable member on the body.

2. The assembly as claimed in claim 1, wherein the coupling arrangement comprises a threaded connection configured to couple the body to a corresponding threaded connection on the well string section.

3. The assembly as claimed in claim 1, wherein the ring member is a sub assembly disposed between the body and the well string section.

4. The assembly as claimed in claim 1, wherein the ring member is configured for threaded connection to the body, and the body and ring member comprise corresponding threaded profiles.

5. The assembly as claimed in claim 4, wherein the threaded profiles comprise buttress threads.

6. The assembly as claimed in claim 4, wherein the threaded profile of one of the body and ring member comprises a box threaded section provided with a shoulder that abuts an end of a pin threaded section of the other of the body and ring member.

7. The assembly as claimed in claim 6, wherein the threaded profiles are provided with an annular recess disposed between the thread and the shoulder.

8. The assembly as claimed in claim 4, wherein:

the ring member is threaded to the body at a first end via the corresponding threaded profiles; and the ring member is threaded to the well string section at a second end via the corresponding threaded profiles, wherein the coupling of the ring member to the body has a torque rating that exceeds a torque rating of the coupling between the ring member and the well string section.

9. The assembly as claimed in claim 4, wherein the coupling of the ring member to the body has a torque rating which exceeds a torque rating of a coupling between a first well string section and a second well string section.

10. The assembly as claimed in claim 4, wherein a seal is provided between the ring member and the body.

11. The assembly as claimed in claim 10, wherein the seal is provided between:

a shoulder of a box threaded section, wherein the box threaded section abuts an end of a pin threaded section; and the end of the pin threaded section.

12. The assembly as claimed in claim 11, wherein the seal comprises a metal to metal seal between the shoulder and the end of the pin threaded section.

13. The assembly as claimed in claim 10 wherein a seal ring is disposed between the box threaded section and the pin threaded section.

14. The assembly as claimed in claim 1, wherein the coupling arrangement comprises:

a first box thread section for receiving a pin thread section of the body; and a second box thread section for receiving a pin thread section of the well string section.

15. The assembly as claimed in claim 1, wherein the coupling arrangement comprises a formation upstanding from the assembly.

16. The assembly as claimed in claim 15, wherein the ring member comprises an internal profile shaped to accommodate the formation upstanding from the assembly.

17. The assembly as claimed in claim 15, wherein the formation is a well string section joint or a part thereof.

18. The assembly as claimed in claim 1, wherein the ring member is configured to be clamped onto a coupling arrangement.

19. The assembly as claimed in claim 1, wherein the ring member cooperates with the swellable member to inhibit extrusion of the swellable member or a part of the swellable member on the body.

20. The assembly as claimed in claim 1, wherein the ring member cooperates with the swellable member to provide stand-off protection to the swellable member or the well string.

21. The assembly as claimed in claim 1, wherein the ring member cooperates with the swellable member to provide centralization of the body or swellable member in the wellbore.

22. The assembly as claimed in claim 1 wherein the abutment surface is placed against an end of the swellable packer element.

23. The assembly as claimed in claim 1 further comprising a shim member that provides an extension to the ring member such that the shim member abuts the swellable member.

24. The assembly as claimed in claim 1 wherein the swellable member comprises end portions that are formed to the full thickness and outer diameter of the swellable member.

25. The assembly as claimed in claim 1 wherein the outer diameter of the ring member is sized to correspond to the outer diameter of the swellable member.

26. A ring member for a well string assembly comprising a well string section and a swellable wellbore packer section coupled together by a coupling arrangement, wherein the ring member is configured to form an annular abutment surface that cooperates with a swellable member disposed on a substantially cylindrical body of the swellable wellbore packer section, wherein the swellable member comprises a material selected to expand on exposure to at least one triggering fluid to create a fluid seal in a wellbore annulus; and wherein the ring member is further configured to be secured in the well string assembly via the coupling arrangement which couples the well string section and the swellable wellbore packer section when in use, wherein the ring member is secured to the body by a first threaded connection with a torque rating that exceeds the torque rating of a coupling between the well string section and another well string section.

27. An apparatus configured to form part of a well string, the apparatus comprising:

a swellable wellbore packer section, comprising:

a substantially cylindrical body having a swellable member disposed thereon, wherein the swellable member comprises a material selected to expand on exposure to at least one triggering fluid to create a fluid seal in a wellbore annulus, and wherein the body is configured to be coupled to a well string section by a coupling arrangement; and a ring member that forms an annular abutment surface that cooperates with the swellable member, secured to the well string via the coupling arrangement, wherein the ring member cooperates with the swellable member to provide centralization of the body or swellable member in the wellbore.

28. A method of forming a swellable packer on a well string, the method comprising the steps of:

providing a swellable member on a substantially cylindrical body of the swellable packer, the swellable member comprising a material selected to expand on exposure to at least one triggering fluid to create a fluid seal in a wellbore annulus;

providing a coupling arrangement for coupling the body to a well string section to form a well string assembly;

securing a ring member in the well string such that the ring member forms an annular abutment surface that cooperates with the swellable member; and securing the ring member to the body by a first threaded connection with a torque rating that exceeds a torque rating of a coupling between a first well string section and a second well string section.

29. The method as claimed in claim 28, including the additional step of coupling the ring member to a well string using a second threaded connection.

30. The method as claimed in claim 28, including the step of coupling the ring member to the body with a torque rating which exceeds a torque rating of the coupling between the ring member and the well string section.

31. The method as claimed in claim 28, including the additional step of providing a seal between the ring member and the body.

32. The method as claimed in claim 28, including the additional step of securing the ring member to the body by disposing the ring member over a formation upstanding from the body.

33. The method as claimed in claim 32, including the additional step of clamping the ring member over the formation.

34. A well string sub assembly configured to form part of a well string, the sub assembly comprising:

a first end comprising a first coupling configured to be connected to a body of a swellable wellbore packer section; and a second end comprising a second coupling configured to be connected to a well string section, wherein the sub assembly forms an annular abutment surface that is configured to cooperate with a swellable member of the swellable wellbore packer section to inhibit axial movement of the swellable member on the body.

* * * * *